United States Patent [19]

Brie et al.

[11] Patent Number: 4,649,696

[45] Date of Patent: Mar. 17, 1987

[54] PROCESS AND APPARATUS FOR WELDING AND CUTTING OFF AT LEAST ONE TOP HORN OF A BAG OF SYNTHETIC MATERIAL

[75] Inventors: Georges Brie; Michel Cazes, both of Vittel, France

[73] Assignee: Societe Generale des Eaux Minerales, Vittel, France

[21] Appl. No.: 748,526

[22] Filed: Jun. 25, 1985

[30] Foreign Application Priority Data

Jun. 25, 1984 [FR] France ..... 84 10094
Jan. 11, 1985 [FR] France ..... 85 00547

[51] Int. Cl.[4] ..... B65B 7/02

[52] U.S. Cl. ..... 53/479; 53/372; 493/342; 493/936

[58] Field of Search ..... 53/372, 479, 476, 389; 493/218, 936, 342

[56] References Cited

U.S. PATENT DOCUMENTS

| | | | |
|---|---|---|---|
| 3,313,216 | 4/1967 | Piazze | 493/936 X |
| 3,469,364 | 9/1969 | Bischoff | 53/372 X |
| 4,041,851 | 8/1977 | Jentsch | 493/218 X |
| 4,251,308 | 2/1981 | Miller | 493/218 X |
| 4,510,732 | 4/1985 | Löthman | 493/218 |

*Primary Examiner*—James F. Coan
*Attorney, Agent, or Firm*—Weiser & Stapler

[57] ABSTRACT

Welding and cutting process in which the bag is disposed in a holding unit (107) supporting and positioning it, and is composed of a side plate (108), a stop plate (109), and a closing angle member.

13 Claims, 9 Drawing Figures

104
105
106
108
109
110
111
112
113
114
115
116
117
118
119

PROCESS AND APPARATUS FOR WELDING AND CUTTING OFF AT LEAST ONE TOP HORN OF A BAG OF SYNTHETIC MATERIAL

The present invention relates to a process and an apparatus for welding and cutting off at least one top horn of a bag of synthetic material, of the type obtained from a cushion filled with liquid and whose two bottom horns have previoulsy been welded and cut off to give the bag stability, this cushion being provided with a handle or rigidification member.

A bag of this type and a process for producing it were the object of French patent application No. 83-18255 in the name of the applicants, to which reference is here expressly made.

The products thus obtained are in the form of bags having a flat base and provided at the top with two horns or corners.

When it is desired to provide a bag of this kind with a gripping and/or rigidification handle, such as that described for example in French patent application No. 83-18257 in the name of the applicants, it is then necessary, in order to achieve better stability of the bag, a good grip and good pouring, to cut off the top horn lying just above this handle.

The present invention seeks to propose a process and an apparatus for achieving this result.

According to the invention a process is proposed for welding and cutting off at least one top horn of a bag of synthetic material, of the type obtained from a cushion filled with liquid and whose two bottom horns have previously been welded and cut off to give the bag stability, this cushion being provided with a handle or rigidification member, characterized in that the process comprises disposing the bag on a flat surface in a holding unit positioning and supporting it, and welding and cutting off said top horn by a welding jaw incorating a cutting device.

The invention further relates to an apparatus for applying this process. In one embodiment the holding unit will be composed of plates forming a closed cage in which the bag is enclosed.

In another embodiment the cage will not be closed, but the positioning and supporting will be assisted by a suction cup.

In the case of a closed cage, certain of the plates may be removable.

In another embodiment the plates may form a rigid receptacle, from which the completed bag is withdrawn after the tipping of the receptacle.

In a modified embodiment the holding unit is composed of a rigid cage fixed in respect of translation to the conveyor belt, thus enabling the bottom horns and the top horn to be gripped and cut off simultaneously.

In this embodiment an optimum arrangement provides a conveyor belt moving continuously together with the cages fixed to it, in which case the cushions must be fed by indexing means.

A device must therefore be provided to ensure that every time a cage is situated under the feed chute a cushion, and only one cushion, will fall into the cage for its final shaping.

According to another modified embodiment this result is obtained with an apparatus for supplying and feeding cushions of flexible synthetic material filled with liquid upstream of a unit forming these cushions into individual bags each provided with a handle, these cushions being supplied by means of a chute to a conveyor belt supporting cages fixed to it in respect of translation, each cage having to receive a cushion for its final shaping, characterized in that it comprises essentially, on the one hand, a rocker at the end of the chute, this rocker receiving in succession the cushions coming from the chute and being operated to rock, in order to release the cushion supported on it, on the passage, vertically in line with the rocker, of each cage on the conveyor belt, and on the other hand a unit enabling each cushion in succession to be retained and released individually on the chute before the cushions reach the rocker, in such a manner as to retain the following cushion when the rocker already contains a cushion and drops it into the arriving cage, and to release the retained cushion for movement onto the rocker when the latter returns to its position.

The invention will be better understood with the aid of the following description of embodiments given as non-limitative examples, with reference to the accompanying drawings, in which:

FIG. 1 is a diagrammatical view of the process according to the invention and of an apparatus for applying it.

FIG. 2*a* illustrates the bag supporting and positioning apparatus in a view in the direction of the arrow A in FIG. 1.

FIG. 2*b* is a variant of the apparatus shown in FIG. 2*a*.

FIGS. 3*a* to 3*c* illustrate the various phases of the work done on the immobilized bag.

Figure 1:
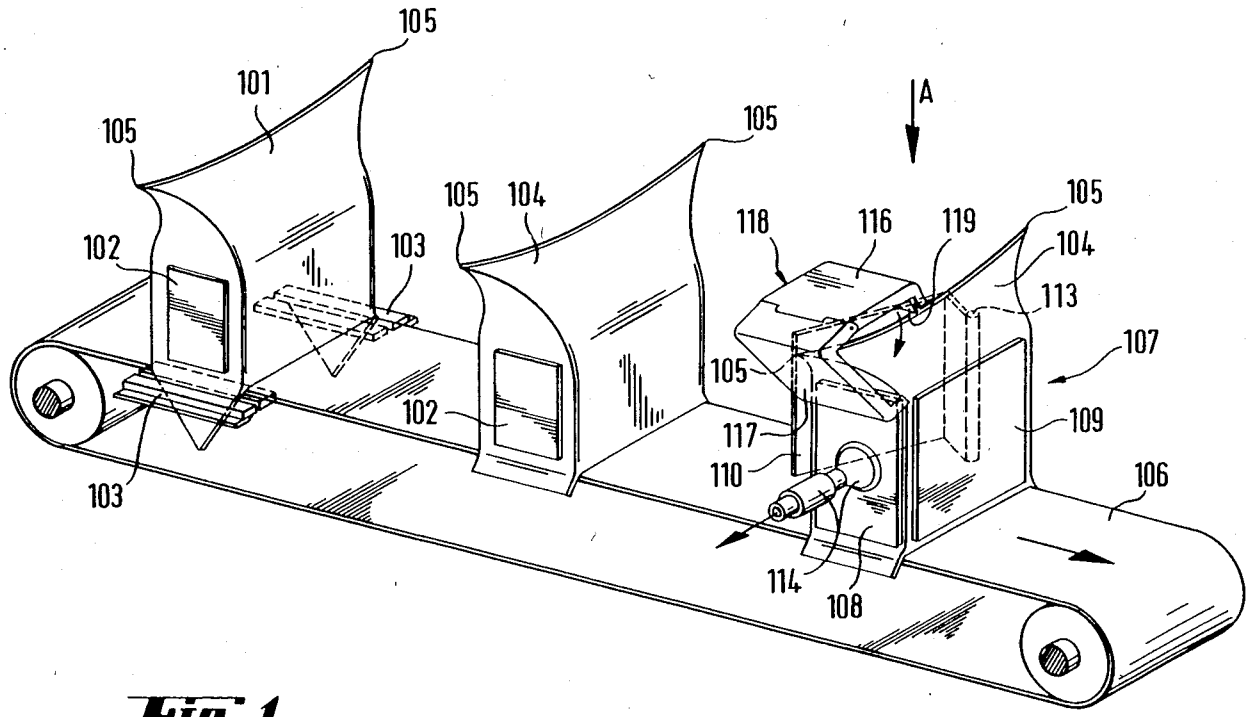
FIG. 1 shows diagrammatically a bag (101) provided with a handle or rigidification member (102), which has been attached to it by either of the processes such as, for example, those described in French patent application No. 83-18257 or the certificate of addition thereto No. 84-10092.

As a reminder, the phase of welding and cutting off the bottom horns has been shown diagrammatically, this phase being previously carried out by a unit (103) such as that described for example in French patent application No. 83-18255 in the name of the applicants.

An intermediate bag is thus obtained, which can be used as it is and which is given the reference (104).

The invention seeks to improve still further the structure of the intermediate bag (104).

In order to do this, it is proposed to cut off the top horn (105) lying directly above the handle (102).

For this purpose, after the bottom horns have been cut off, the bags (104) are placed one by one on a conveyor belt (106) operating with indexing and bringing the bags to a holding unit (107) which supports and positions them for the purpose of carrying out the desired welding and cutting operations.

This holding unit is composed of a side plate (108), a stop plate (109), and a closing angle member (110).

Figures 2A, 2B, 3A, 3B, 3C:
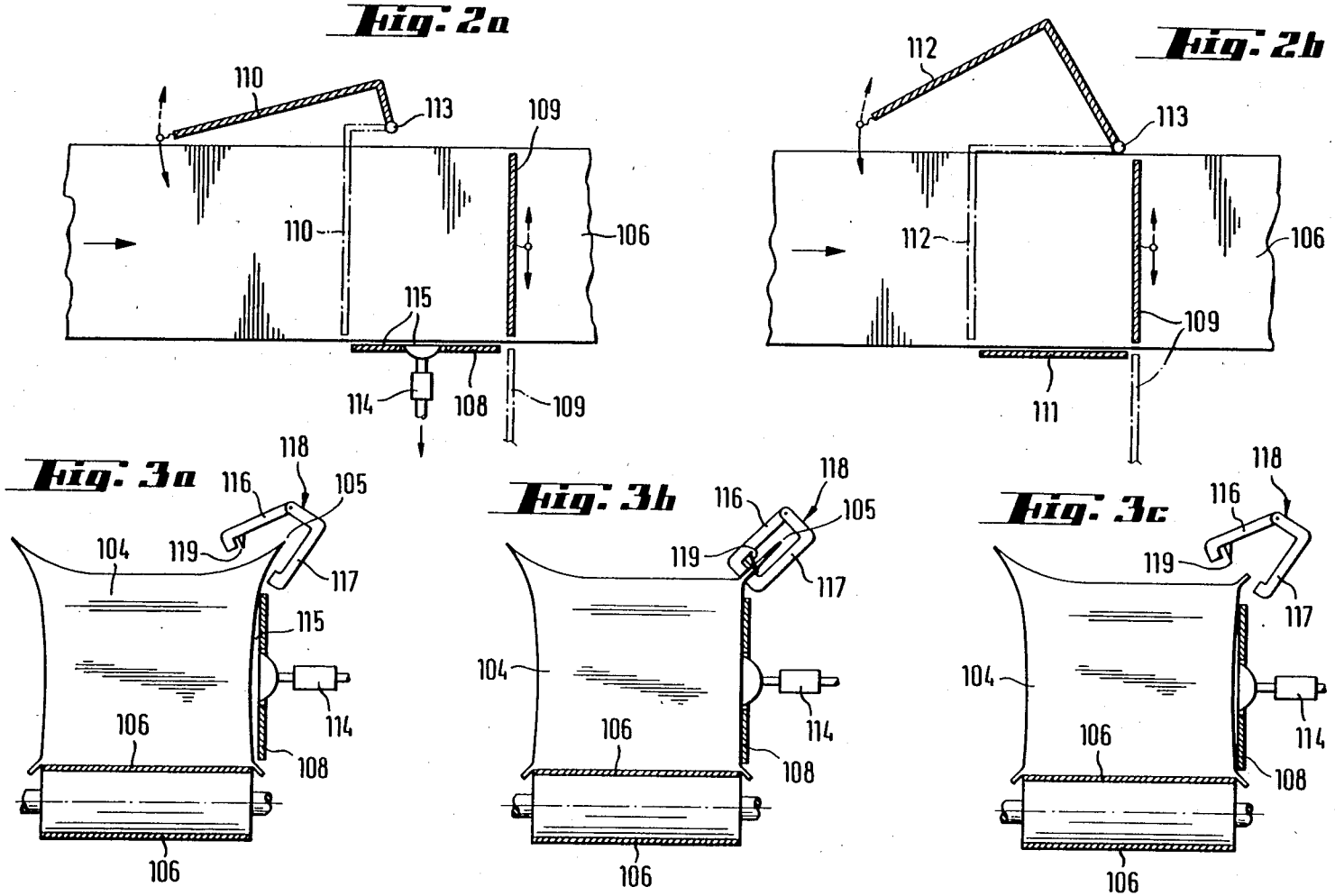

Referring to FIG. 2*a*, it can be seen that the side plate (108) is fixed. The stop plate (109), against which the bag brought up by the belt (106) abuts, is movable.

When the bag is held fast by the plates (108) and (109), it is securely supported and locked by the action of the movable angle member (110) pivoting on a pin (113), on the one hand, and, on the other hand, a suction cup (114) operating in translation through an opening (115) provided in the plate (108).

In this embodiment the holding unit forms a cage partly open on one side (opposite the suction cup).

In the variant shown in FIG. 2*b*, the fixed side plate (111) is retained (without an opening), and the stop plate (109) is likewise retained, but the angle member (112) extends further around the bag, so that the holding unit forms a practically closed cage in such a manner that by itself it supports and positions the bag without the aid of a suction cup.

In this position the top horn (105) of the bag is disposed between the two pivoting jaws (116, 117) of a soldering gripper (118), which also incorporates a cutting tool (119).

The welding and cutting are effected automatically as soon as the bag is finally positioned, for example through the action of the suction cup (114), as shown in FIG. 3*b*.

The gripper (118), the suction cup (114), the plate (109), and the plates (110 and 112 respectively) are then released or removed, the bag being freed by the conveyor belt at the same time as the next bag is placed in position.

All the operations obviously take place in a sequential and ordered manner, use being made of pneumatic, mechanical and electrical devices within the competence of those versed in the art.

Figure 4:
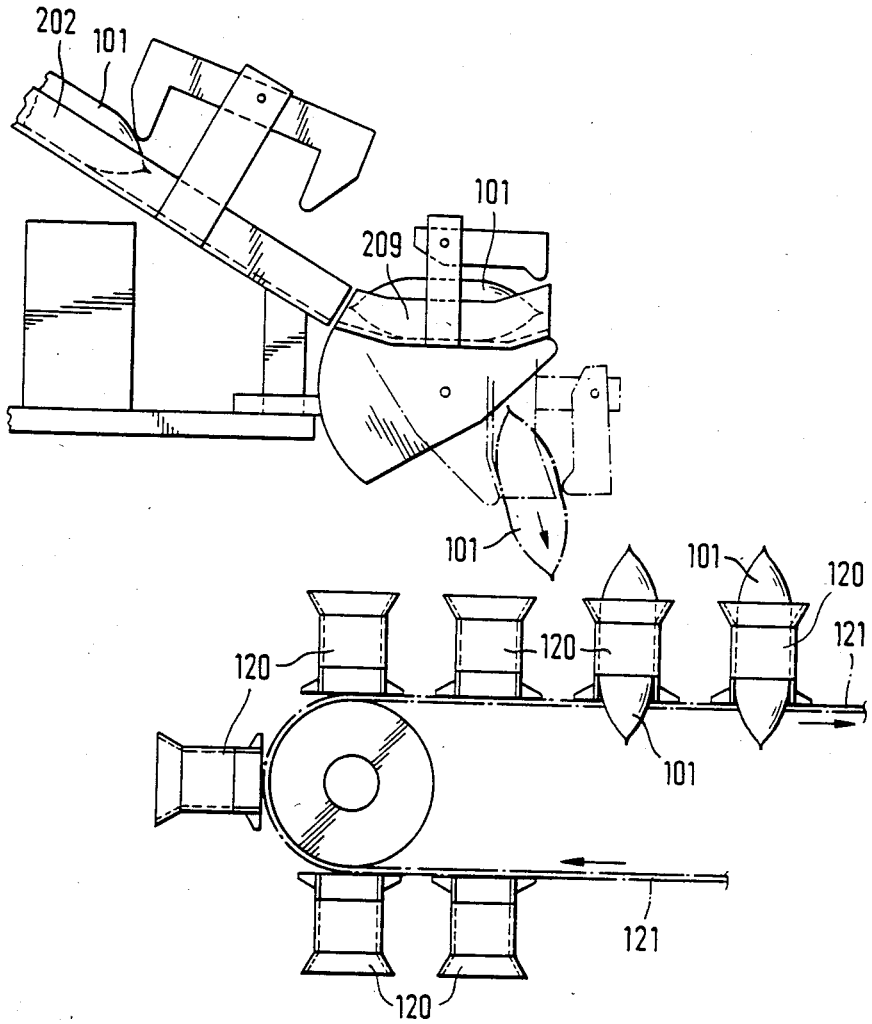
FIG. 4 shows a variant of an apparatus according to the invention.

In an alternative embodiment illustrated in FIG. 4, the holding unit is a rigid cage (120) into which the cushions fall.

The cage is fixed in respect of translation to the conveyor belt (121).

In this apparatus the gripping and cutting-off of the bottom horns and one of the top horns are effected while the cushion is in this cage.

The finished bag is discharged from the cage when the latter tips on reaching the end roller of the conveyor belt.

Figure 5:
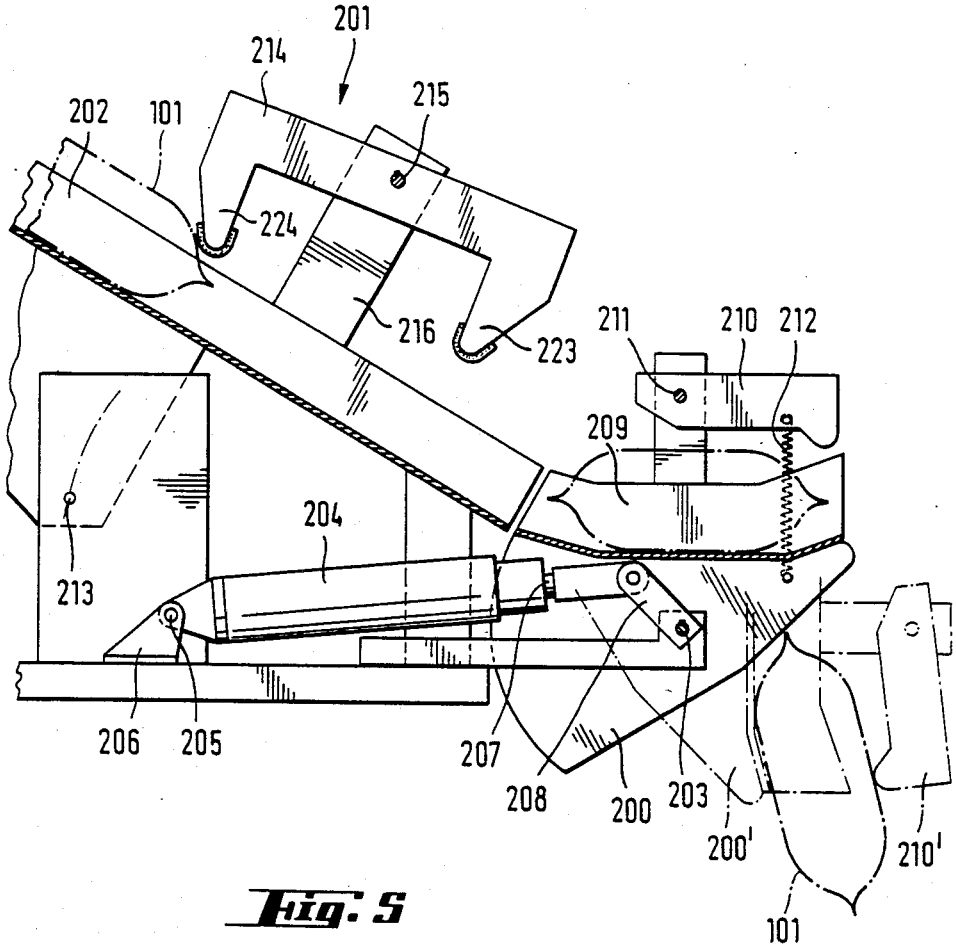
FIG. 5 is a diagrammatical view in elevation of a modified embodiment of the invention, showing the members controlling the rocker.
Figure 6:
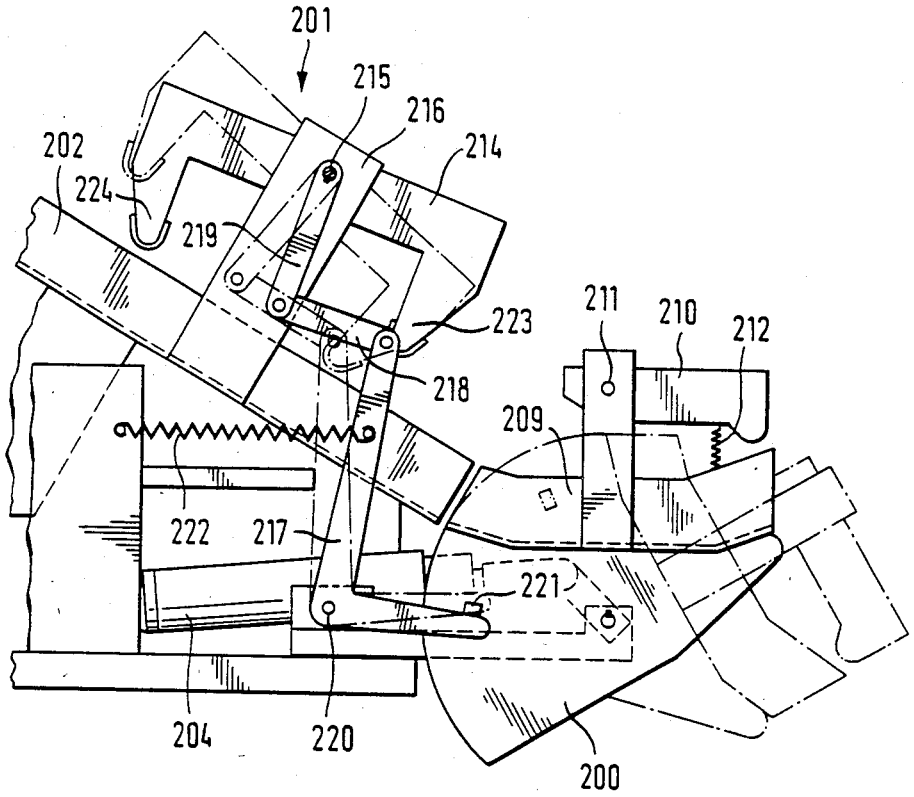
FIG. 6 is a diagrammatical side view of elevation of the apparatus shown in FIG. 5, showing the members controlling the unit holding and releasing the cushions on the chute.

Reference will now be made to FIGS. 5 and 6, which show an apparatus disposed upstream of the apparatus shown in FIG. 4.

As indicated previously, this apparatus is composed essentially of:

a rocker (200), a retaining and release unit (201), a chute (202).

The operation of the rocker will be explained first. The rocker is intended to feed cushions to the cages moving past under it, each cage having to receive one cushion.

When each cage arrives under the rocker a proximity detector (not shown) triggers the rocking of the rocker about its pivot pin (203) with the aid of a power cylinder (204) whose cap (205) is connected to the frame (206), and whose rod (207) is connected by a connecting rod (208) to the pivot pin (203). The extension and retraction of the power cylinder rod therefore control respectively the rocking of the rocker and its return to its position.

In order to ensure correct positioning of each cushion on the rocker, the latter may in addition have a chute-shaped section (209) which will come into line with the chute (202), and a support jaw (210) pivoted on the body of the rocker on a pivot pin (211). This jaw serves to hold the cushion on the rocker as long as possible, so that it will fall as nearly vertically as possible. The opening of the jaw (210) is controlled by a roller which is rotationally fixed to the rocker and the displacement of which, during the rocking, drives a lever which releases the jaw. The jaw is in addition returned by a return spring (212) fixed on the one hand to the jaw and on the other hand to the rocker (200). The final position of the rocker (200′) and of the jaw (210′) at the moment of the release of the cushion is shown in dotted lines.

It has already been indicated that the cushions come from a chute (202). Depending on the nature of the products packed, the desired speed, and the volume of the cushions, it is desirable for the chute to be provided with a conventional slope regulation device (213) comprising essentially a pin adapted to occupy any position in a curved opening and able to be locked in each of these positions.

Reference will now be made to FIG. 6. As the individual cushions arrive one after the other via the chute (202), it is necessary to prevent each following cushion from striking against the rocker (200) during the rocking of the latter because, in addition to the damage inflicted on the cushion remaining on the chute, there is a risk that the rocker will drive the two cushions, which obviously must be avoided.

The object of the unit (201) is to avoid such a situation.

The unit (201) is composed essentially of a double arm (214) pivoted about a pin (215) mounted in a fork (216) fastened to the frame.

The turning of the double arm is controlled by a lever (217) and an assembly comprising a connecting rod (218) and a crank (219).

The lever (217) is controlled in respect of rotation about its axis (220) on the one hand by a stud (221) fastened to the rocker (200) and on the other hand by a return spring (222).

The operation is as follows. When a cushion has been loaded onto the rocker, the downstream arm (223) is lowered towards the chute and prevents any possible passage of a cushion toward the rocker. When the rocker progressively pivots in order to free its cushion, the double arm (214) also pivots progressively about its axis and the upstream arm (224) then prevents the cushions from moving down toward the rocker. When the rocker rises again, the front arm frees the cushion which it was holding back, and this cushion arrives on the rocker when the latter returns to its position.

In order to prevent damage to the cushions, the ends of the arms (223, 224) will be protected by a flexible material and rounded.

We claim:

1. In a process for welding and cutting off at least one top horn of a bag of synthetic material, said bag being of the type obtained from a cushion filled with a liquid and having two bottom corners which have previously been welded and cut off to give the bag stability, and said cushion being provided with a handle or rigidification member, the improvement comprising the steps of:

disposing the bag on a flat surface in a holding unit positioned and supported on the flat surface and including a side plate, a removable stop plate, and a closing angle member which is pivotable about a pivot point;

closing the angle member over the bag disposed within the holding unit; and welding and cutting off the top horn of the bag by a welding jaw incorporating a cutting device.

2. In an apparatus for welding and cutting off at least one top horn of a bag of synthetic material, said bag being of the type obtained from a cushion filled with a liquid and having two bottom corners which have previously been welded and cut off to give the bag stability, and said cushion being provided with a handle or rigidification member, the improvement which comprises an indexing conveyor belt (106) for bringing bags (104) to a holding unit (107) for supporting and positioning the bags (104) on the conveyor belt (106), said holding unit (107) having a side plate (108, 111), a removable stop plate (109), and a closing angle member (110, 112) which is pivoted on a pivot pin (113).

3. Apparatus according to claim 2, characterized in that the apparatus further comprises a welding gripper (118) provided with two pivoted jaws (116, 117) and incorporating a cutting tool (119).

4. Apparatus according to claim 2, characterized in that the holding unit is composed of a rigid cage (120) fixed in respect of translation to the conveyor belt (121) and permitting the gripping and cutting-off of the bottom horns and the top horn simultaneously.

5. Apparatus according to claim 2, characterized in that the apparatus further comprises a suction cup (114) operating through an opening (115) in the plate (111), said suction cup (114) being adapted for translatory movement.

6. Apparatus for supplying and feeding cushions of flexible synthetic material filled with liquid up-stream of a unit forming said cushions into individual bags each provided with a handle, according to claim 8, said cushions being supplied by means of a chute means to a conveyor means having supporting cages means fixed in respect of translation to said conveyor means, each cage means receiving a cushion for the purpose of its final shaping, characterized in that the apparatus comprises essentially, on the one hand, a rocker means (200) at the end of the chute means (202), said rocker means (200) successively receiving each cushion coming from the chute and being controlled in respect of its rocking, for the purpose of releasing the cushion supported by it, when each cage means on the conveyor means passes vertically in line with the rocker means, and on the other hand a means (201) for permitting the successive retention and release of each cushion individually on the chute means before the cushions reach the rocker means, said means (201) being controlled by the rocker means so as to retain the following cushion when the rocker means already contains a cushion and drops it into the arriving cage means and to free said cushion for movement onto the rocker means when the latter returns to its position.

7. Apparatus according to claim 6, characterized in that said means (201) comprises a double arm (214) pivoted about a pivot pin (215), the turning of said arm being controlled by a lever (217) and an assembly comprising a connecting rod (218) and a crank (219), said lever being controlled in respect of rotation about its axis (220) on the one band by a stud (221) fastened to the rocker means (200) and on the other hand by a return spring means (222).

8. Apparatus according to claim 7, characterized in that the double arm (214) comprises an upstream arm (224) and a downstream arm (223) which are adapted to release or to retain the cushions moving downwards in the chute.

9. Apparatus according to claim 8, characterized in that the ends of the arms (223, 224) are rounded and protected by flexible material.

10. Apparatus according to claim 6, characterized in that the rocking of the rocker means (200) about its pivot pin (203) is controlled by a proximity detector on the passing of each cage means, a power cylinder (204) operatively connected to said rocker means having a rod (207) connected by a connecting rod (208) to a pivot pin (203).

11. Apparatus according to claim 6, characterized in that the rocker means (200) comprises in addition a supporting jaw means (210) pivoted on the body of the rocker means by a pivot pin (211).

12. Apparatus according to claim 11, characterized in that the opening of said jaw means (210) is controlled by a roller which is rotationally fixed to the rocker means and the displacement of which, when the rocking occurs, drives a lever which releases the jaw means, the latter being returned by a spring means (212).

13. Apparatus according to claim 6, characterized in that the chute means is provided with a slope adjustment means (213).

* * * * *